US008282110B2

(12) United States Patent
Schubert

(10) Patent No.: US 8,282,110 B2
(45) Date of Patent: Oct. 9, 2012

(54) CARGO CONTAINER SYSTEM WITH SELECTIVELY DEPLOYABLE SUPPORT AND WHEEL ASSEMBLIES

(76) Inventor: Eric Raymond Schubert, New Boston, MI (US)

( * ) Notice: Subject to any disclaimer, the term of this patent is extended or adjusted under 35 U.S.C. 154(b) by 100 days.

(21) Appl. No.: 12/368,204

(22) Filed: Feb. 9, 2009

(65) Prior Publication Data

US 2010/0019470 A1 Jan. 28, 2010

Related U.S. Application Data

(60) Provisional application No. 61/135,717, filed on Jul. 23, 2008.

(51) Int. Cl.
*B60B 33/04* (2006.01)

(52) U.S. Cl. ..... 280/43

(58) Field of Classification Search ..... 280/423.1, 280/476.1, 763.1, 6.15, 43, 47, 43.27; 180/209; 296/182.1, 184.1, 37.2
See application file for complete search history.

(56) References Cited

U.S. PATENT DOCUMENTS

| | | | | |
|---|---|---|---|---|
| 2,418,178 | A * | 4/1947 | Huebshman | 296/37.2 |
| 2,806,710 | A * | 9/1957 | Mascaro | 280/414.5 |
| 3,788,683 | A * | 1/1974 | Rumell | 410/66 |
| 4,527,486 | A * | 7/1985 | Baird et al. | 105/215.2 |
| 5,050,897 | A * | 9/1991 | Stromberg | 280/43 |
| 5,154,265 | A * | 10/1992 | Capistrant | 190/18 A |
| 5,801,317 | A | 9/1998 | Liston et al. | |
| 6,439,131 | B1 * | 8/2002 | Higgins | 105/215.2 |
| 6,793,271 | B1 | 9/2004 | Deets | |
| 2006/0186616 | A1 * | 8/2006 | Rudiger | 280/6.15 |
| 2010/0187782 | A1 * | 7/2010 | Facey et al. | 280/30 |

FOREIGN PATENT DOCUMENTS

| | | |
|---|---|---|
| JP | 09-309588 | 12/1997 |
| WO | WO 03-010051 | 2/2003 |

OTHER PUBLICATIONS

English Abstract of JP 09-309588.
International Search Report for PCT US/2009/004297.
Written Opinion of the International Searching Authority for PCT US/2009/004297.

* cited by examiner

*Primary Examiner* — Tony Winner
(74) *Attorney, Agent, or Firm* — Preston Smirman; Smirman IP Law, PLLC

(57) ABSTRACT

A cargo container system is provided having selectively deployable support and wheel assemblies. The support and wheel assemblies are capable of being stowed within a recess formed in the underside of the cargo container system during storage or shipment of the cargo container system (e.g., by ship, rail, and/or the like). At an appropriate time (e.g., the cargo container system is about to placed onto the ground by a crane), the support and wheel assemblies are then selectively deployed downwardly and/or outwardly from the recess of the underside of the cargo container system to provide a fully functional cargo container system/trailer combination that is immediately capable of being engaged to a truck/tractor and driven away. The deployment system can include a screw system that, when rotated in a first direction is operable to raise the support and wheel assemblies and then, when rotated in a second direction is capable of lowering the support and wheel assemblies.

13 Claims, 8 Drawing Sheets

10
12
14
18
20
22
24
26
28
30
32
34
36
38
40
42
44
46
48
50

CARGO CONTAINER SYSTEM WITH SELECTIVELY DEPLOYABLE SUPPORT AND WHEEL ASSEMBLIES

CROSS-REFERENCE TO RELATED APPLICATION

The instant application claims priority to U.S. Provisional Patent Application Ser. No. 61/135,717, filed Jul. 23, 2008, the entire specification of which is expressly incorporated herein by reference.

FIELD OF THE INVENTION

The present invention relates generally to cargo containers and, more specifically, to a cargo container system with selectively deployable support and wheel assemblies.

BACKGROUND OF THE INVENTION

The use of shipping containers has allowed the transshipment of large amounts of cargo from one seaport to another seaport. For example, large cargo ships are able to carry several dozen, or hundreds, and in some cases well over a thousand cargo containers, which are typically secured onto their decks or stored in their holds, from one port in one part of the world to a destination port on the other side of the globe. This shipping method has allowed cargo to be transported in a manner that would not be economically feasible or practicable by other conventional shipping methods, e.g., by air, rail or road.

When the cargo ship reaches its destination seaport, it is typically necessary to unload the cargo containers, whether they be loaded or empty, into holding areas because immediately placing the cargo containers onto the trailers of trucks (i.e., tractors) is a very time consuming and labor intensive process. Additionally, a great number of trailers must also be stored at the seaport to eventually be matched up with the great number of cargo containers. Because keeping dozens or hundreds of drivers and their tractors and/or trailers waiting in the confined space of a seaport loading dock is wasteful and impractical, many of the cargo containers have to be stored for a period of several days to several months until they can be matched up with an available driver and a tractor trailer. Thus, a typical busy seaport may have hundreds, and quite probably thousands, of cargo containers stacked in holding areas waiting for tractors and/or trailers to be brought into place wherein a crane (or other suitable device) can lift the cargo container and place it onto the trailer, whereupon the cargo container is secured to the trailer.

Therefore, it would be advantageous to provide a new and improved cargo container system that overcomes at least one of the aforementioned problems.

SUMMARY OF THE INVENTION

In accordance with the general teachings of the present invention, a new and improved cargo container system is provided, wherein the cargo container system includes selectively deployable support and wheel assemblies. That is, the support and wheel assemblies are capable of being stowed within a recess, formed in the underside of the cargo container system, during storage or shipment of the cargo container system (e.g., during sea travel or rail travel). At an appropriate time (e.g., the cargo container system is about to placed onto the ground or other surface by a crane or other suitable device), the support and wheel assemblies are then selectively deployed downwardly and/or outwardly from the recess of the underside of the cargo container system to provide a fully functional cargo container system/trailer combination that is immediately capable of being engaged to a truck/tractor and driven away.

In accordance with one aspect of the present invention, an optional chassis can be incorporated into a lower portion of the cargo container system. The chassis can provide a support structure for attachment of the support and wheel assemblies thereto. A deployment system cooperates with the support and wheel assemblies in manner that allows the deployment system to raise the support and wheel assemblies and then, when desired, lower the support and wheel assemblies. In accordance with another aspect of the present invention, the deployment system can include a screw system that, when rotated in a first direction is operable to raise the support and wheel assemblies and then, when rotated in a second direction (e.g., opposite of the first direction) is capable of lowering the support and wheel assemblies.

In accordance with still another aspect of the present invention, an axle system is provided that is operably associated with the screw system such that, as the screw system is rotated (e.g., in a clockwise or counter-clockwise manner), it can translate the rotational movement of the screw system into rotation (e.g., in a forward or reverse manner) of the axle system that is perpendicular to the rotation of the screw system.

In accordance with still yet another aspect of the present invention, a secondary screw system is provided that is operably associated with the support and wheel assemblies such that, as the axle system is rotated (e.g., in a forward or reverse manner), it can translate the rotational movement of the axle system into rotation (e.g., in a clockwise or counter-clockwise manner) of the secondary screw system that is perpendicular to the rotation of the axle system, thus raising or lowering the support and wheel assemblies. The secondary screw system can also provide a locking function to keep the support and wheel assemblies in a fixed position. By way of a non-limiting example, the direction of the rotation of the screw system and the secondary screw system may be configured to be opposite of one another. By way of a non-limiting example, when the screw system is rotated in a clockwise direction, the secondary screw system can be caused to rotate in counter-clockwise direction by appropriate rotation of the axle system. By way of another non-limiting example, when the screw system is rotated in a counter-clockwise direction, the secondary screw system can be caused to rotate in clockwise direction by appropriate rotation of the axle system.

In accordance with one embodiment of the present invention, a cargo container system is provided, comprising: a cargo container having a pair of spaced and opposed sidewall members; a deck member disposed in an interior space of the cargo container; a recess defined by a lower surface of the deck member and a lower surface of the sidewall members; and a support assembly or wheel assembly selectively deployable from or storable in the recess.

In one aspect of this embodiment, a bottom member interconnects the sidewall members to at least partially enclose the recess. In another aspect of this embodiment, the cargo container includes a forward portion and a rearward portion, the forward portion having a shorter height than the height of the rearward portion, wherein the difference in height between the forward portion and the rearward portion is substantially equivalent to the height of the recess. In still another aspect of this embodiment, the support assembly or the wheel assembly is selectively pivotable about an axis, wherein the support assembly is selectively operable to pivot arcuately downwardly away from the recess, and wherein the wheel assembly is selectively operable to pivot arcuately downwardly away from the recess towards an exterior surface of the sidewall members. In yet another aspect of this embodiment, a deployment system is selectively operable to cause the support assembly or the wheel assembly to pivot about an axis into a deployed position or a stored position, wherein the deployment system includes a selectively rotatable screw system, wherein the screw system is selectively operable to rotate in a first direction to cause deployment of the support assembly or the wheel assembly from the recess and selectively operable to rotate in a second direction to cause storing of the support assembly or the wheel assembly in the recess. In still yet another aspect of this embodiment, a selectively rotatable axle system is operably associated with the screw system, wherein the axle system rotates in a perpendicular direction to the rotation of the screw system. In a further aspect of this embodiment, a selectively rotatable second screw system is operably associated with the axle system, wherein the second screw system rotates in a perpendicular direction to the rotation of the axle system, wherein the second screw system rotates in an opposite direction as the screw system. The secondary screw system can also provide a locking function to keep the support and wheel assemblies in a fixed position.

In accordance with another embodiment of the present invention, an air testing system for a cargo container system is provided, comprising: an air intake port formed on a portion of the cargo container system; a conduit system in fluid communication with the air intake port; and a plurality of apertures formed in the conduit system.

In accordance with one aspect of this embodiment, the conduit system is disposed on or in an interior ceiling, wall or deck surface of the cargo container system. In accordance with another aspect of this embodiment, the conduit system includes at least one tube member. In accordance with still another aspect of this embodiment, an amount of air is introduced into the air intake port, through the conduit system, and out through the plurality of apertures. In accordance with still yet another aspect of this embodiment, an air outlet port is formed in a portion of the cargo container system, the air outlet port selectively operable to receive any circulating air in the interior of the cargo container system.

Further areas of applicability of the present invention will become apparent from the detailed description provided hereinafter. It should be understood that the detailed description and specific examples, while indicating the preferred embodiment of the invention, are intended for purposed of illustration only and are not intended to limit the scope of the invention.

BRIEF DESCRIPTION OF THE DRAWINGS

Other advantages of the present invention will be readily appreciated as the same becomes better understood by reference to the following detailed description when considered in connection with the accompanying drawings wherein.

The same reference numerals refer to the same parts throughout the various Figures.

DETAILED DESCRIPTION OF THE INVENTION

The following description of the preferred embodiment(s) is merely exemplary in nature and is in no way intended to limit the invention, or uses.

Referring to the Figures generally, a new and improved cargo container system is generally shown at 10. Although the cargo container system 10 is shown as being similar to a conventional trailer, it should be appreciated that the cargo container system 10 can be configured in any number of different shapes and designs. By way of a non-limiting example, the cargo container system 10 can be configured as a temperature controlled trailer or container (e.g., a "reefer") that could include insulated walls, ceiling and floor. By way of another non-limiting example, the cargo container system 10 could be configured as a bulk commodities container (e.g., having holes in the ceiling to load commodities and possibly doors on the bottom to unload bulk commodities). By way of still another non-limiting example, the cargo container system 10 could also contain ramps inside the interior space that could either move up or down or be fixed in place, so as to be able to haul vehicles therein.

Figures 1, 2, 3:
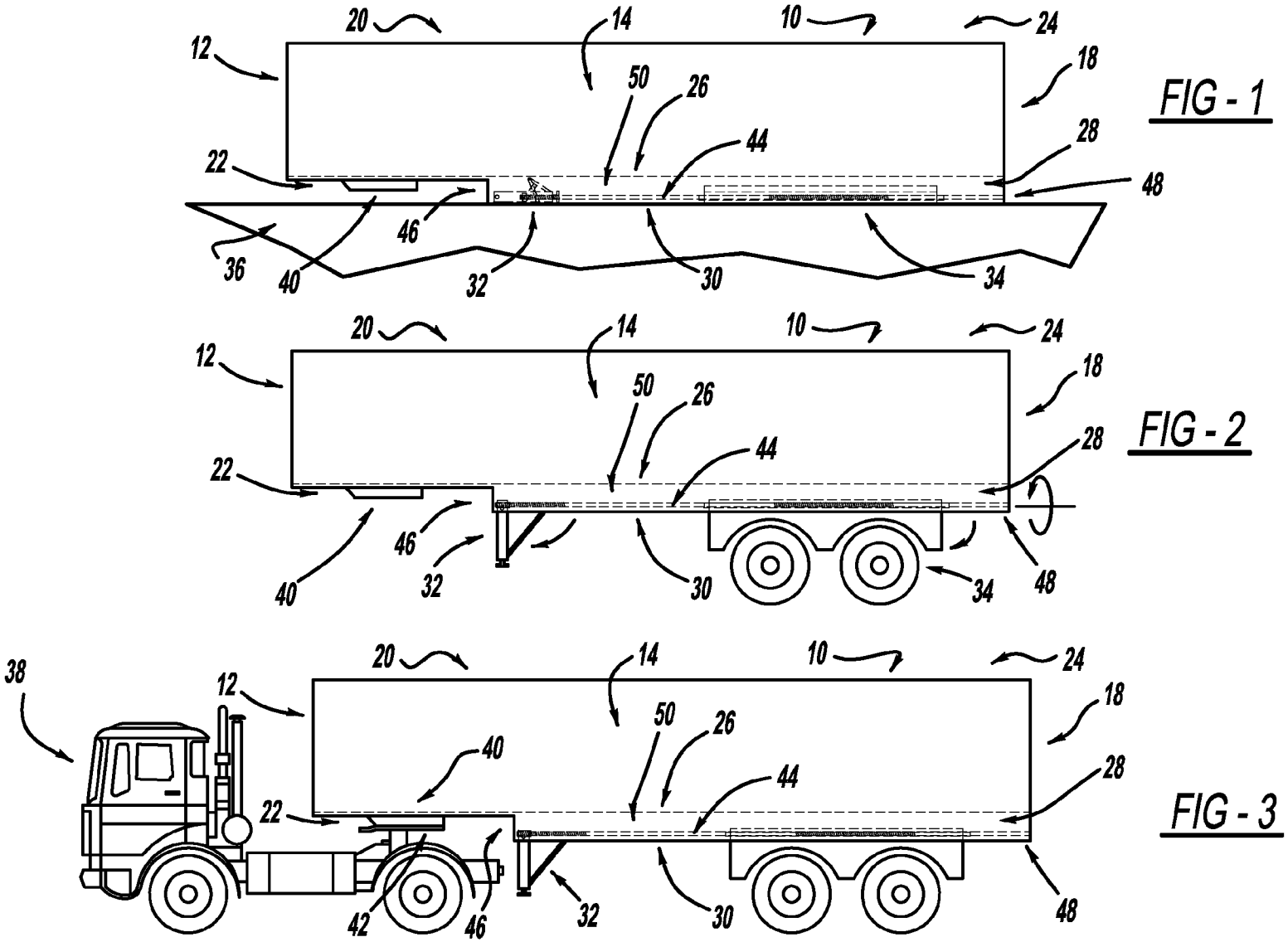
FIG. 1 is schematic elevational view of a cargo container system on top of a transportation system, in accordance with a first embodiment of the present invention.
FIG. 2 is a schematic elevational view of a cargo container system with its support and wheel assemblies in the deployed position to form a cargo container system/trailer combination, in accordance with a second embodiment of the present invention.
FIG. 3 is a schematic elevational view of the cargo container system/trailer combination operably associated with a truck or tractor, in accordance with a third embodiment of the present invention.
Figure 4:
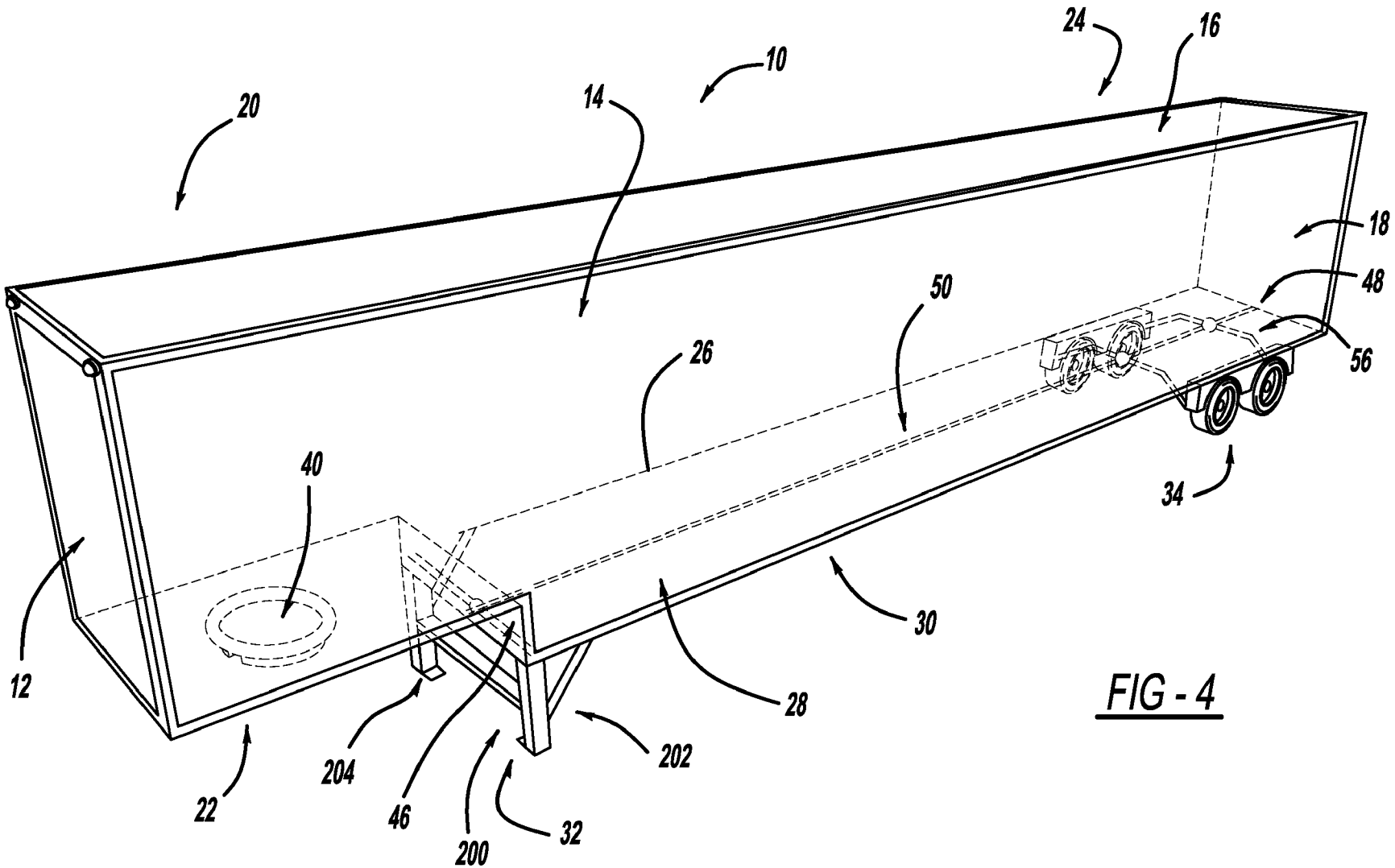
FIG. 4 is a front perspective view of a cargo container system with its support and wheel assemblies in the deployed position to form a cargo container system/trailer combination, in accordance with a fourth embodiment of the present invention.
Figure 5:
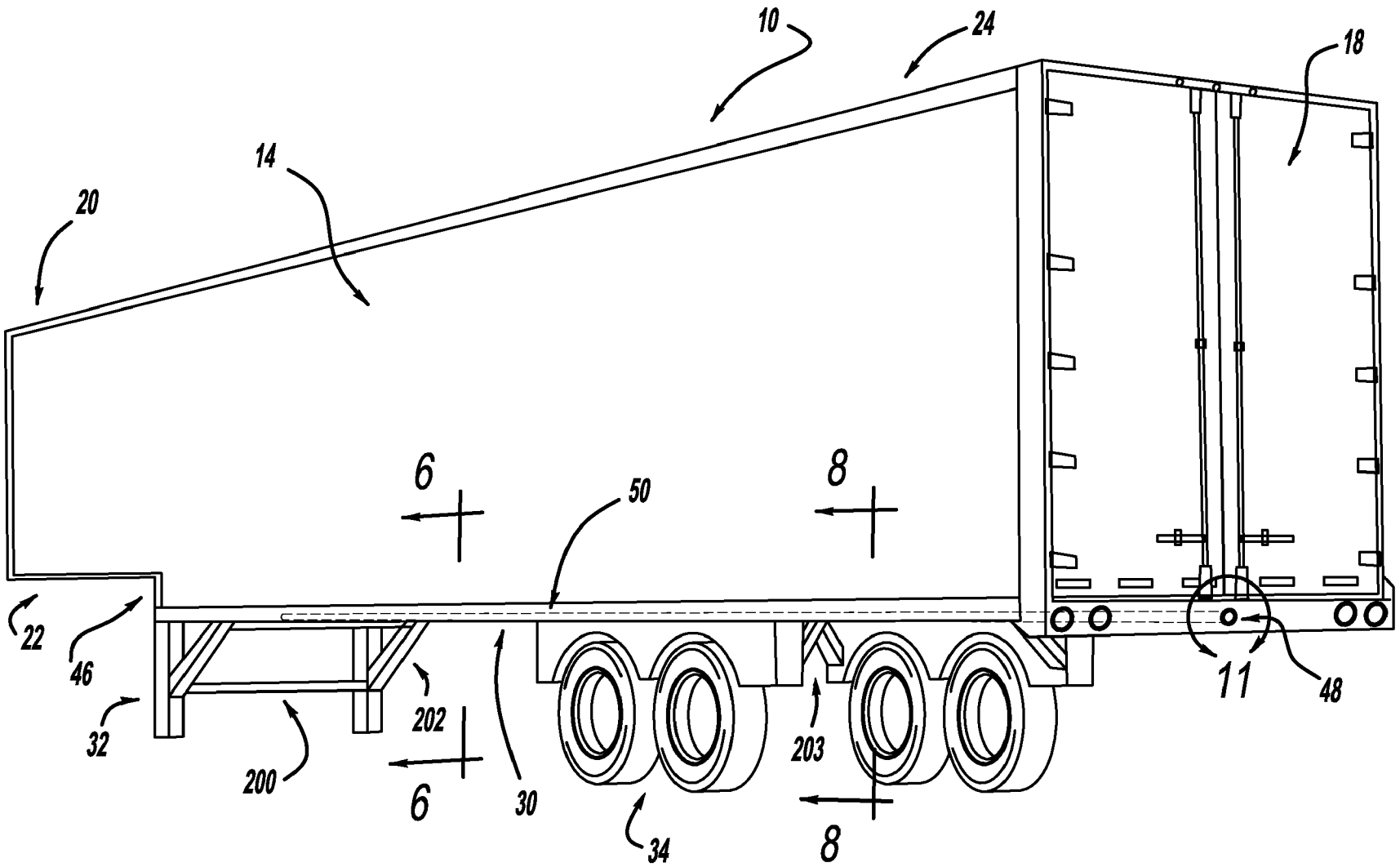
FIG. 5 is a rear perspective view of a cargo container system with its support and wheel assemblies in the deployed position to form a cargo container system/trailer combination, in accordance with a fifth embodiment of the present invention.
Figure 6:
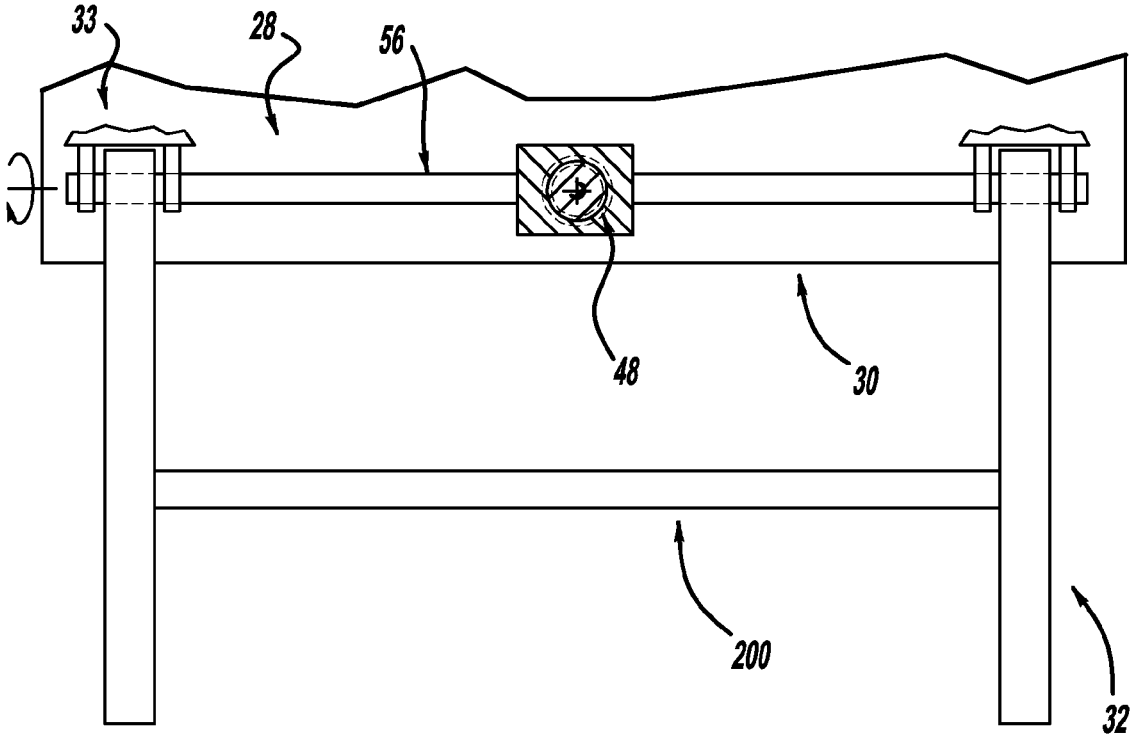
FIG. 6 is a schematic sectional view taken along line 6-6 of FIG. 5, in accordance with a sixth embodiment of the present invention.
Figure 7:
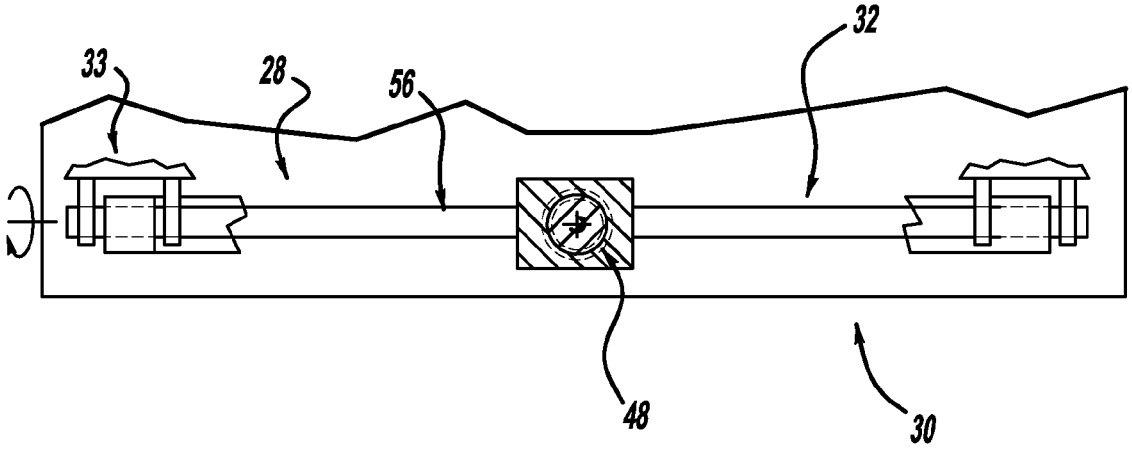
FIG. 7 is a schematic sectional view illustrating the support assembly of FIG. 6 in the stowed position, in accordance with a seventh embodiment of the present invention.
Figure 8:
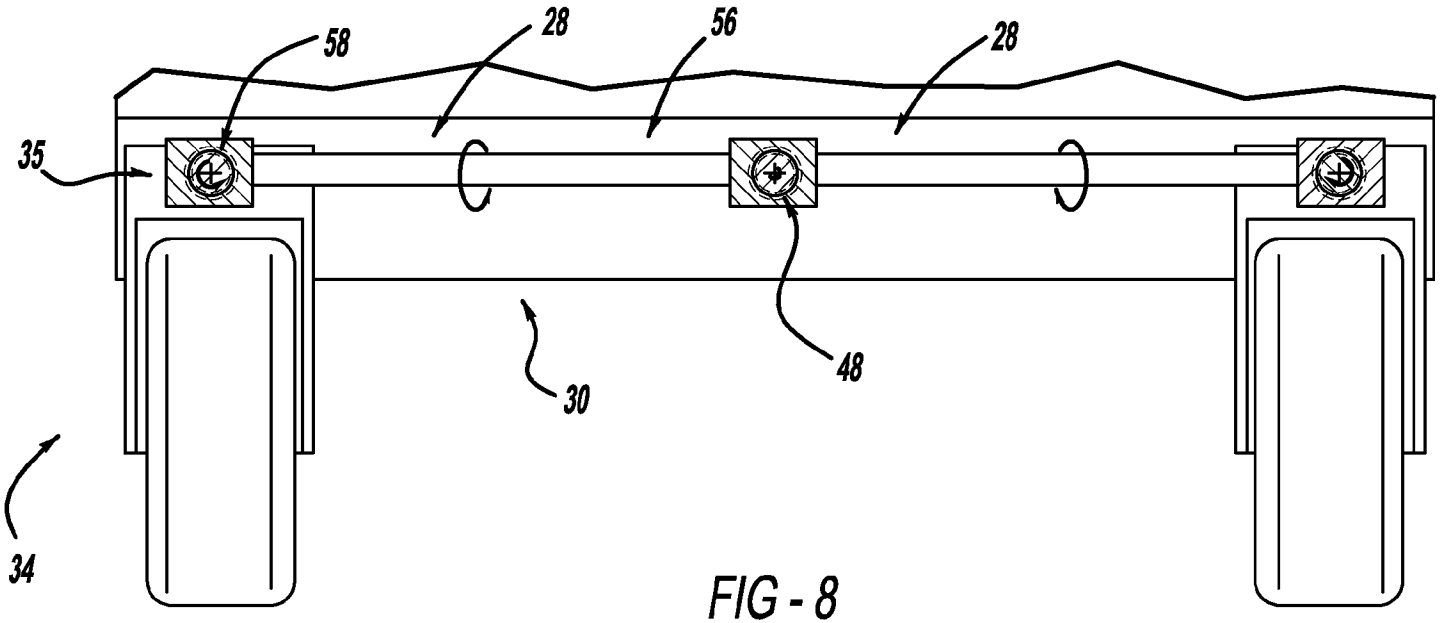
FIG. 8 is a schematic sectional view taken along line 8-8 of FIG. 5, in accordance with an eighth embodiment of the present invention.
Figure 9:
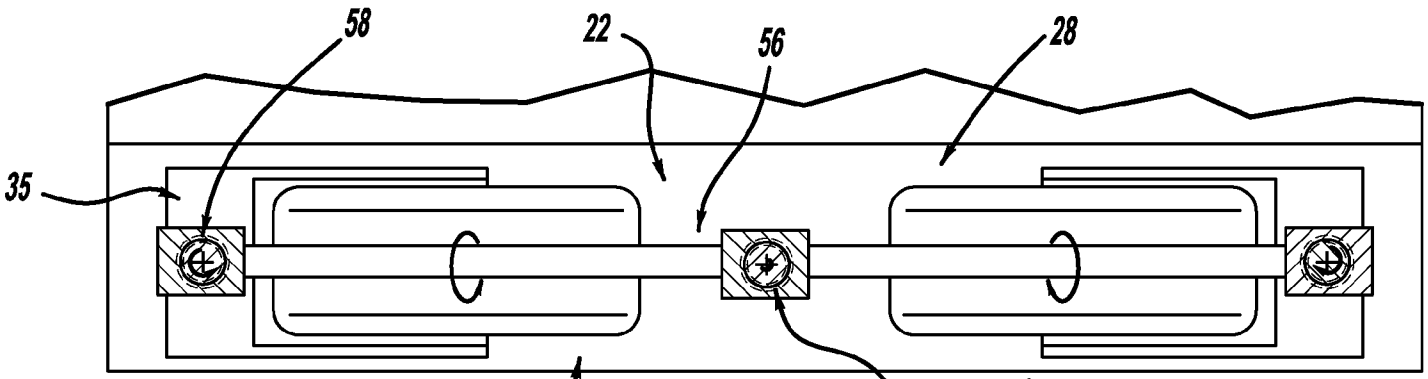
FIG. 9 is a schematic sectional view illustrating the wheel assembly of FIG. 8 in the stowed position, in accordance with a ninth embodiment of the present invention.

Referring specifically to FIGS. 1, 4 and 5, the cargo container system 10 primarily includes a front wall portion 12, two spaced and opposed side wall portions 14, 16, respectively, and a rear door system 18. The forward portion 20 of the cargo container system 10 includes an attic portion 22, that is, an area of decreased overall height as compared to the rearward portion 24 of the cargo container system 10. Contained within the interior of the cargo container system 10 is a floor or deck portion 26 that defines a cavity or recess 28 between the deck portion 26 and the undercarriage surface 30 of the cargo container system 10. The undercarriage surface 30 could be continuous or could be provided with apertures formed therein. The intended purpose or function of this recess 28 will be explained herein. Referring specifically to FIGS. 1, 7 and 9, the appropriate or requisite height of the recess 28, i.e., the distance between the deck portion 26 and the undercarriage surface 30, will be dependent, at least in part, on the ability to accommodate or store a stowed support assembly 32 and/or wheel assembly 34 therein, as will be described herein.

Referring again to FIG. 1, the cargo container system 10, when the support assembly 32 and/or wheel assembly 34 is stowed in the recess 28, can be placed on any generally flat surface, such as but not limited to a transportation system 36, such as, but not limited to, a ship, rail car, flat bed truck, another cargo container system, the ground, and/or the like. In this manner, the cargo container system 10 can be handled and shipped in a like manner to that of conventional ocean containers, rail box cars, semi-trailers, and/or the like.

One feature of the present invention is that the cargo container system 10 includes a selectively deployable support assembly 32 and/or wheel assembly 34. That is, while the stowability or storability of the support assembly 32 and/or wheel assembly 34 in the recess 28 allows the stacking feature of the cargo container system 10, the ability of the support assembly 32 and/or wheel assembly 34 to be deployed, as specifically shown in FIGS. 2-6, 8, 10, 12, and 13, enables the cargo support system 10 to function as a combination container/trailer system. That is, this feature of the present invention obviates the need for a separate trailer system to be used, as the cargo container system 10 can function as both a cargo storage system and, simultaneously, as a trailer system. In this aspect, the present invention provides for the support assembly 32 and/or the wheel assembly 34 being capable of being stowed within the recess 28, formed in the underside of the cargo container system 10, e.g., during storage or shipment of the cargo container system 10 (e.g., during sea travel or rail travel). At an appropriate time (e.g., when the cargo container system 10 is about to placed onto the ground or other surface by a crane or other suitable device), the support assembly 32 and/or the wheel assembly 34 can then be selectively deployed downwardly and/or outwardly from the recess 28 of the underside of the cargo container system 10 so as to provide a fully functional cargo container system/trailer combination that is immediately capable of being engaged to a truck/tractor 38 (e.g., via a king-pin 40 (formed on the underside 42 of the attic portion 22) that conventionally engages a fifth wheel assembly 42 formed on the truck/tractor 38) and immediately driven away. Thus, the previously described, time-consuming, and laborious process of mounting and securing shipping containers onto the trailers of trucks/tractors has been eliminated. It should also be noted that additional cargo, supplies, tools, and/or the like, can be stored in the recess 28, as well.

In accordance with one aspect of the present invention, an optional, and highly simplified, chassis 44 can be incorporated into a lower portion 46 of the cargo container system 10, e.g., in proximity to the undercarriage surface 30. Thus, the chassis 44 can provide a support structure for attachment of the support assembly 32 and/or wheel assembly 34 thereto. However, it should be understood that rather than using a chassis, the lower portion 46 of the cargo container system 10 can be manufactured with strong and rigid materials (e.g., steel cross beams or supports) that could obviate the need for a chassis. However, although the chassis 44 is optional, its presence can add increased structural support and rigidity to the lower portion 46 of the cargo container system 10, without the need to reinforce the lower portion 46 of the cargo container system 10.

In accordance with another aspect of the present invention, a deployment system 48 cooperates with the support assembly 32 and/or the wheel assembly 34 in a manner that allows the deployment system 48 to raise the support assembly 32 and/or the wheel assembly 34 and then, when desired, lower the support assembly 32 and/or the wheel assembly 34. It should be noted that the deployment system 48 can function in a manner that it can raise and/or lower the support assembly 32 and/or the wheel assembly 34 simultaneously and/or sequentially.

Figure 11:
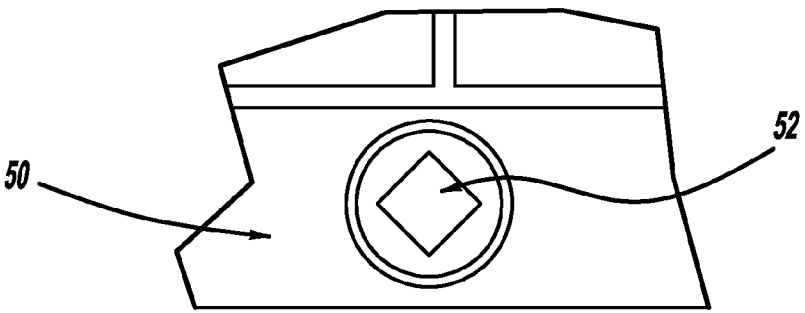
FIG. 11 is a partial elevational view illustrating a keyed insertion portion of the deployment system, in accordance with an eleventh embodiment of the present invention.
Figure 12:
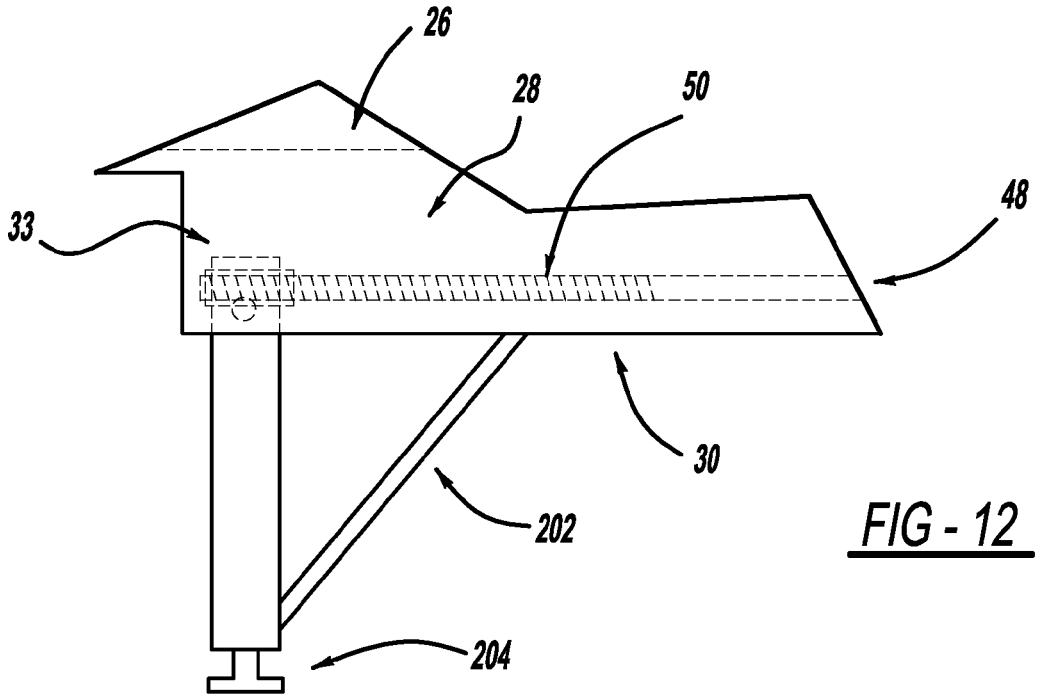
FIG. 12 is a partial schematic elevational view illustrating the deployment system of the support assembly, in accordance with a twelfth embodiment of the present invention.
Figure 13:
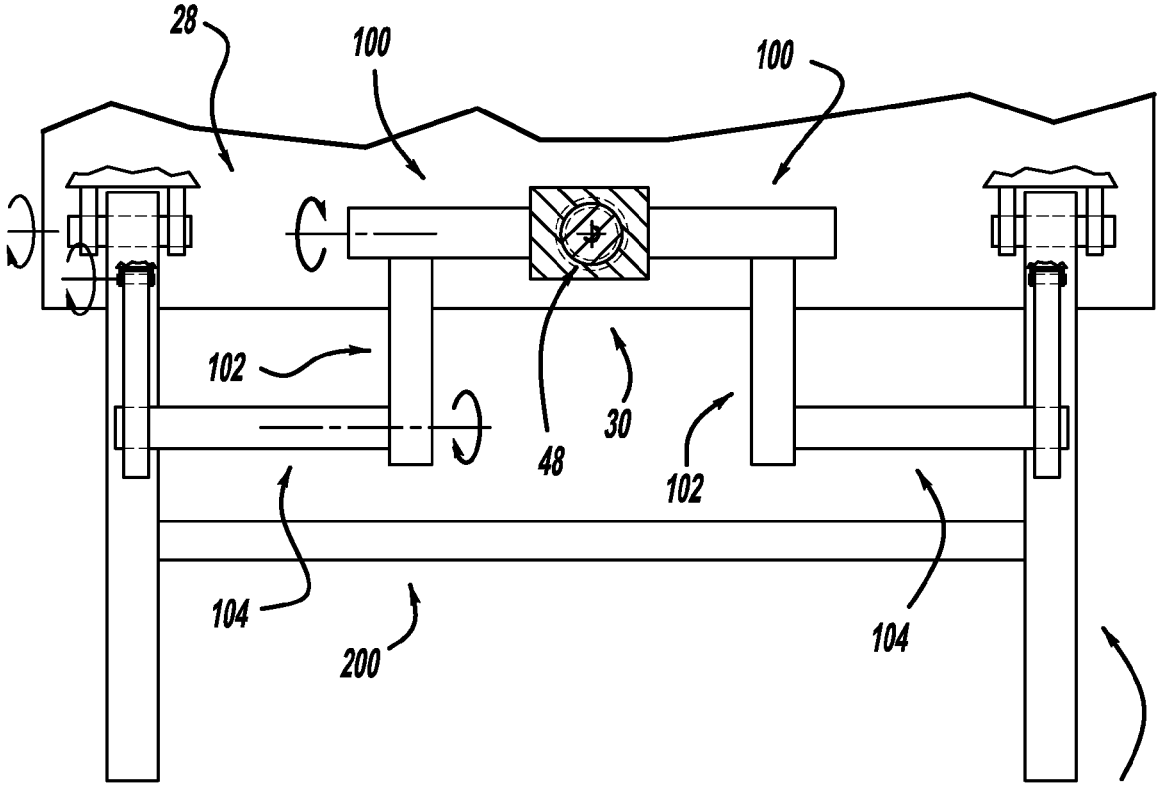
FIG. 13 is a schematic sectional view illustrating an alternative support assembly in the deployed position, in accordance with a thirteenth embodiment of the present invention.

In accordance with still another aspect of the present invention, the deployment system 48 can include a screw system 50 that, when rotated in a first direction is operable to raise the support assembly 32 and/or the wheel assembly 34 and then, when rotated in a second direction (e.g., opposite of the first direction) is capable of lowering the support assembly 32 and/or the wheel assembly 34. Referring specifically to FIG. 11, the rotation of the screw system 50 can be accomplished by inserting a rotation member (not shown), such as but not limited to a handle, crank, or other suitable device, into a keyed insertion portion 52 (e.g., formed on the rear surface 54 of the cargo container system 10) of the screw system 50 and rotating in the appropriate direction. Of course, the rotation of the screw system 50 can be accomplished by any number of conventional methods, including using manually or automatically controlled power devices, such as geared motors, pneumatically actuated systems, hydraulically actuated systems, and/or the like.

Figure 10:
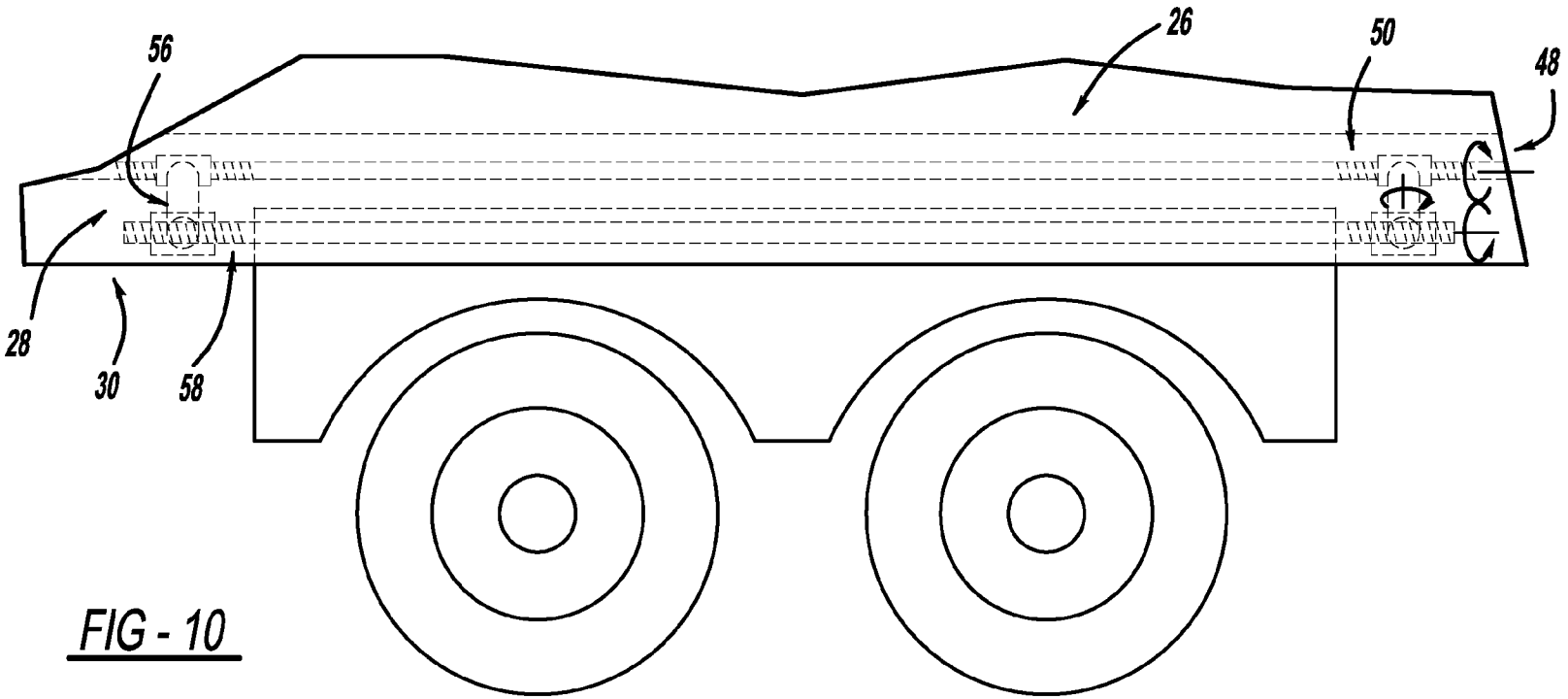
FIG. 10 is a partial schematic perspective view of the deployment system of the wheel assembly, in accordance with a tenth embodiment of the present invention.

In accordance with yet another aspect of the present invention, an axle system 56 is provided that is operably associated with the screw system 50 such that, as the screw system 50 is rotated (e.g., in a clockwise or counter-clockwise manner), it can translate the rotational movement of the screw system 50 into rotation (e.g., in a forward or reverse manner) of the axle system 56 that is perpendicular to the rotation of the screw system 50. By way of a non-limiting example, this relative movement of the axle system 56 by the screw system 50 can be accomplished through a rack and pinion system, differential system, or any other number of conventional devices and/or methods. It should be noted that the axle system 56 does not interconnect the individual wheels on either side of the cargo container system 10, as would be the case with a conventional ith still yet another aspect of the present invention, a secondary screw system 58 is provided that is operably associated with the wheel assembly 34 such that, as the axle system 56 is rotated (e.g., in a forward or reverse manner), it can translate the rotational movement of the axle system 56 into rotation (e.g., in a clockwise or counter-clockwise manner) of the secondary screw system 58 that is perpendicular to the rotation of the axle system 56, thus raising or lowering the wheel assembly 34 (e.g., via rotation of a mounting plate 35). The secondary screw system 58 can also provide a locking function to keep the wheel assembly 34 in a fixed position. By way of a non-limiting example, this relative movement of the secondary screw system 58 by the axle system 56 can be accomplished through a rack and pinion system, a differential system, or any other number of conventional devices and/or methods. By way of a non-limiting example, the rotational direction of the screw system 50 and the secondary screw system 58 may be configured to be opposite of one another. For example, when the screw system 50 is rotated in a clockwise direction, the secondary screw system 58 can be caused to rotate in counter-clockwise direction by appropriate rotation of the axle system 56 (e.g., as shown in FIG. 10). Likewise, when the screw system 50 is rotated in a counter-clockwise direction, the secondary screw system 58 can be caused to rotate in clockwise direction by appropriate rotation of the axle system 56 (e.g., the respective rotation directions of the arrows shown in FIG. 10 would all be reversed). By way of a non-limiting example, the rotation of the secondary screw system 58 can be accomplished by inserting a rotation member (not shown), such as but not limited to a handle, crank, or other suitable device, into another keyed insertion portion (not shown), e.g., formed on the rear surface 54 of the cargo container system 10, of the screw system 50 and rotating in the appropriate direction. For example, this arrangement can be useful in the event that free movement of the screw system 50 is compromised or the screw system 50 becomes inoperational.

It should also be noted that the screw system 50 can be configured to only unlock the axles and supports from a locked position (or vice versa), and that the secondary screw system 58 can be configured to only raise or lower the appropriate wheel or support assemblies with respect to the recess (or vice versa).

In accordance with an alternative embodiment of the present invention, the operation of the deployment system 48 with respect to the support system 32 can be more simplified than that of the wheel assembly 34. For example, with specific reference to FIGS. 6, 7 and 12, the use of a secondary screw system can be eliminated (with respect to the support assembly 32) and the support assembly 32 (e.g., via rotation about a mounting plate 33) can be raised or lowered by appropriate rotation of the axle system 56 alone (e.g., in response to appropriate rotation of the screw system 50). It should be noted that the same screw system 50 can be used to raise or lower both the support assembly 32 as well as the wheel assembly 34. The screw system 50 can also provide a locking function to keep the support assembly 32 and/or the wheel assembly 34 in a fixed position.

In accordance with another alternative embodiment of the present invention, the operation of the deployment system 48 with respect to the support system 32 can be more complex than that of the wheel assembly 34. For example, with specific reference to FIG. 13, while the use of a secondary screw system is also eliminated in this embodiment (with respect to the support assembly 32), the use of multiple axle systems 100, 102, 104, respectively, are used to raise or lower (e.g., via rotation about a mounting plate 35) the support assembly 32 (e.g., in response to appropriate rotation of the screw system 50). Again, it should be noted that the same screw system 50 can be used to raise or lower both the support assembly 32 as well as the wheel assembly 34. The screw system 50 can also provide a locking function to keep the support assembly 32 and/or the wheel assembly 34 in a fixed position.

Regardless of the system used to raise or lower the support assembly 32, the support assembly 32 can be provided with cross members 200, as well as braces 202 (e.g., which may rotate and/or collapse/telescope when in the stowed position in order to reduce the overall height of the support assembly 32), to provide increased strength thereto. Additionally, the support assembly 32 can be provided with adjustable leg members 204 to adjust the relative height of the deployed support assembly 32. Additionally, when in the deployed position, the support assembly 32 can be provided with a mechanism such as a slot, groove, detent, stop, and/or the like (not shown) to lock the support assembly 32 in place for obvious safety reasons. Furthermore, the deployment system 48 can be provided with a locking mechanism (not shown) to prevent access to or rotation of the screw system 50 when the support assembly 32 is in the deployed position (e.g., to prevent unintentional retraction to the stowed position) or in the stowed position (e.g., to prevent unintentional deployment).

With respect to the wheel assembly 34, because there is no cross-axle as in conventional trailers, each wheel, or wheel grouping in the case of multi-wheel assemblies, is a self-contained unit 300 that includes, primarily, a brake assembly (e.g., employing pneumatic or air brakes), an axle assembly (e.g., for allowing the wheel to freely rotate thereabout), and a suspension system (e.g., employing a shock absorber). By way of a non-limiting example, the brake system of the truck/tractor 38 can be connected to an air line (not shown) having a port (not shown) on the forward portion 20 of the cargo container system 10 and disposed along the length of the recess 28 and ultimately connected to each of the air brakes lines of the brake systems of the individual wheels of the wheel assembly 34. An example of a self-contained brake, axle, and suspension system for a wheel assembly that would be suitable for use with the present invention is readily commercially available from Tridec BV (Ekkersrijt, The Netherlands) under the product designation Type LV-O. However, any support or wheel assembly that can be rotated up and down, in or out, or otherwise, relative to the underside or lower portion of a cargo container, would be suitable for use with the present invention. Furthermore, although the drawings depict a "double axle" wheel assembly, it should be appreciated that the present invention can be practiced with either less than or more than this number of wheel pairs.

As with the support assembly 32, when in the deployed position, the wheel assembly 34 can be provided with a mechanism such as a slot, groove, detent, stop, and/or the like (not shown) to lock the wheel assembly 34 in place for obvious safety reasons. Furthermore, the deployment system 48 can be provided with a locking mechanism (not shown) to prevent access to or rotation of the screw system 50 when the wheel assembly 34 is in the deployed position (e.g., to prevent unintentional retraction to the stowed position) or in the stowed position (e.g., to prevent unintentional deployment).

Regardless of the system used to raise or lower the wheel assembly 34, the wheel assembly 34 can be provided with braces 203 (e.g., which may rotate and/or collapse/telescope when in the stowed position in order to reduce the overall height of the wheel assembly 34), to provide increased strength thereto.

Other well known elements of cargo containers, such as, but not limited to, brake lights, signal lights, doors, door handles, door locks, and/or the like, which are conventional in nature, will not be described herein but can be used in conjunction with the cargo container system of the present invention.

Figures 14, 15:
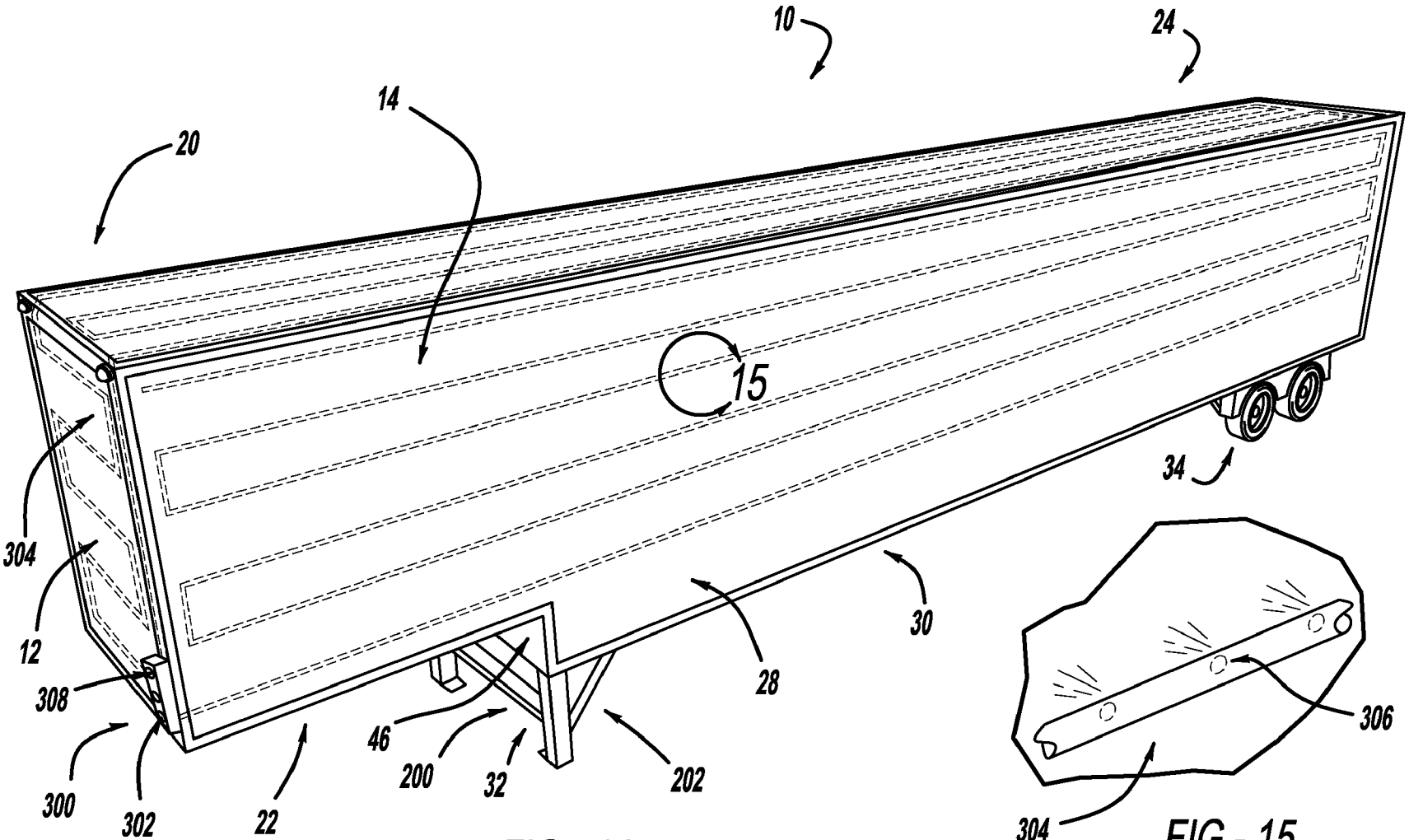
FIG. 14 is a perspective view illustrating an air testing system for the interior space of the cargo container system, in accordance with a fourteenth embodiment of the present invention.
FIG. 15 is a partial detailed view of a portion of the air testing system depicted in FIG. 14, in accordance with a fifteenth embodiment of the present invention.

With specific reference to FIGS. 14 and 15, there is shown still another alternative embodiment of the present invention, wherein the cargo container system 10 is provided with an air testing system 300. The air testing system 300 allows an individual to sample the air within the interior space of the cargo container system 10 to determine whether there are any illegal or prohibited substances therein (e.g., illegal drugs, explosives, nuclear materials, and so forth). Because there are so many cargo containers coming into various ports throughout the world, testing of individual containers is a highly time consuming and laborious process. Thus, the proposed testing system aims to provide a quick and efficient manner to test air samples from each and every cargo container coming into a port.

By way of a non-limiting example, an air intake port 302 is provided on the exterior surface of the cargo container system 10 (the exact location of the air intake port 302 is not thought to be critical to the success of the present invention). The air intake port 302 is in communication with a tube system 304. The tube system 304 can be comprised of a single tube or a series of tubes which are preferably ultimately in communication with the air intake port 302. The tube system 304 should extend along the majority of the length of the interior of the cargo container system 10. By way of a non-limiting example, the tube system 304 can extend along the ceiling and/or walls of the interior of the cargo container system 10. The tube system 304 should not be placed on the top of the deck portion 26, as any cargo loaded thereon could damage the tube system 304. However, the tube system 304 can also be embedded within the ceiling, walls, and/or the deck portion 26, e.g., to prevent damage to the tube system 304. The tube system 304 is provided with a plurality of perforations 306 (e.g., holes) formed therein that allow air in the tube system 304 to be expelled out through the perforations 306 and into the interior of the cargo container system 10. Thus, if the tube system 304 is embedded, the perforations 306 should be able to communicate with the interior of the cargo container system 10. The tube system 304, if comprised of a series of tubes, can be either closed or open at the respective end portions.

To test the air of the interior of the cargo container system 10, air (e.g., pressurized air) or other gas/fluid is introduced into the air intake port 302 and allowed to flow through the tube system 304 and out through the perforations 306 into the interior of the cargo container system 10. This flow of air creates air circulation in the interior of the cargo container system 10 in a manner that causes any fumes, vapors or particles (e.g., dust, explosives residue, chemicals, and/or the like) emanating from the cargo present in the interior of the cargo container system 10 to be circulated there around. After a sufficient period of time, a sampling device (e.g., a suction hose attached to a testing device) is attached to an air outlet port 308 provided on the exterior surface of the cargo container system 10 (the exact location of the air outlet port 308 is not thought to be critical to the success of the present invention). A sample of the circulating air in the interior of the cargo container system 10 is gathered and analyzed to determine the presence of any illegal or prohibited substances therein (e.g., illegal drugs, explosives, nuclear materials, and so forth). The entire testing process could be accomplished in a matter of a few minutes or less.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cargo container system, comprising:

a cargo container having a pair of spaced and opposed sidewall members;

a deck member disposed in an interior space of the cargo container;

a recess defined by a lower surface of the deck member and a lower surface of the sidewall members;

a support assembly or wheel assembly selectively deployable from or storable in the recess; and an engagement system located on a surface of the cargo container, wherein the engagement system is selectively operable to engage the cargo container to a motor vehicle.

2. The container system according to claim 1, wherein the support assembly or the wheel assembly is selectively pivotable about an axis.

3. The container system according to claim 2, wherein the support assembly is selectively operable to pivot arcuately downwardly away from the recess.

4. The container system according to claim 2, wherein the wheel assembly is selectively operable to pivot arcuately downwardly away from the recess towards an exterior surface of the sidewall members.

5. A cargo container system, comprising:

a cargo container having a pair of spaced and opposed sidewall members;

a deck member disposed in an interior space of the cargo container;

a recess defined by a lower surface of the deck member and a lower surface of the sidewall members; and a support assembly or wheel assembly selectively deployable from or storable in the recess;

wherein the cargo container includes a forward portion and a rearward portion, the forward portion having a shorter height than the height of the rearward portion.

6. The container system according to claim 5, wherein a difference in height between the forward portion and the rearward portion is substantially equivalent to the height of the recess.

7. A cargo container system, comprising:

a cargo container having a pair of spaced and opposed sidewall members;

a deck member disposed in an interior space of the cargo container;

a recess defined by a lower surface of the deck member and a lower surface of the sidewall members;

a support assembly or wheel assembly selectively deployable from or storable in the recess; and a deployment system selectively operable to cause the support assembly or the wheel assembly to pivot about an axis into a deployed position or a stored position;

wherein the deployment system includes a selectively rotatable screw system.

8. The container system according to claim 7, wherein the screw system is selectively operable to rotate in a first direction to cause deployment of the support assembly or the wheel assembly from the recess and selectively operable to rotate in a second direction to cause storing of the support assembly or the wheel assembly in the recess.

9. The container system according to claim 7, further comprising a selectively rotatable axle system operably associated with the screw system.

10. The container system according to claim 9, wherein the axle system rotates in a perpendicular direction to the rotation of the screw system.

11. The container system according to claim 9, further comprising a selectively rotatable second screw system operably associated with the axle system.

12. The container system according to claim 11, wherein the second screw system rotates in a perpendicular direction to the rotation of the axle system.

13. The container system according to claim 12, wherein the second screw system rotates in an opposite direction as the screw system.

* * * * *